United States Patent [19]

Respen et al.

[11] 4,016,015

[45] * Apr. 5, 1977

[54] ROLLED STEEL ROD OR BAR

[75] Inventors: Yves Jean Respen, Herstal; Paul Andre Cosse, Bellaire; Mario Economopoulos, Liege, all of Belgium

[73] Assignee: Centre de Recherches Metallurgiques-Centrium voor Research in de Metallugie, Brussels, Belgium

[ * ] Notice: The portion of the term of this patent subsequent to Dec. 16, 1992, has been disclaimed.

[22] Filed: Sept. 26, 1975

[21] Appl. No.: 617,156

Related U.S. Application Data

[62] Division of Ser. No. 411,227, Oct. 31, 1973, Pat. No. 3,926,689.

[30] Foreign Application Priority Data

Oct. 31, 1972 Belgium ..... 790867

[52] U.S. Cl. ..... 148/39; 148/12.4; 148/144; 148/145; 148/156; 148/157

[51] Int. Cl.[2] ..... C22C 35/00

[58] Field of Search ..... 148/12 R, 12.4, 12 B, 148/13, 14, 18, 39, 143, 144, 145, 153, 152, 156, 157

[56] References Cited

UNITED STATES PATENTS

| | | | |
|---|---|---|---|
| 2,753,260 | 7/1956 | Payson | 148/39 X |
| 3,345,220 | 10/1967 | Haynes | 148/39 X |
| 3,489,620 | 1/1970 | Current | 148/39 X |

*Primary Examiner*—Arthur J. Steiner
*Attorney, Agent, or Firm*—Holman & Stern

[57] ABSTRACT

Steel rod or bar at the exit of the finishing stand of a hot rolling mill is superficially quenched, so that the surface layer of the rod or bar is given a bainitic or martensitic structure. Immediately after quenching, the core of the rod or bar is at about 850° C and, therefore, still austenitic. Subsequent air cooling allows the austenite to transform to ferrite and carbides, while the surface layer is tempered by the heat transferred to it from the core.

5 Claims, 4 Drawing Figures

(500X)

(500X)

ROLLED STEEL ROD OR BAR

This is a divisional of application Ser. No. 411,227 filed Oct. 31, 1973, now U.S. Pat. No. 3,926,689.

BACKGROUND OF THE INVENTION

The present invention relates to a treatment for improving the quality of a rolled steel rod or bar and especially a concrete-reinforcing rod or bar.

The process can be applied to both killed and semi-killed steels and rimming steels.

The main qualities looked for in a steel rod or bar are, inter alia, as high as possible a 'yield point' for the grade of steel used, as well as weldability, fatigue resistance, and sufficient ductility for the intended use.

To improve the weldability and ductility of steel, it is necessary to reduce its carbon and manganese contents, which, however, causes a reduction in its tensile strength. In order to remedy this disadvantage, the steel can be subjected to a suitable cooling treatment, preferably applied directly at the exit of the rolling mill, which enables the 'yield point' of the rod or bar to be raised to some extent.

When a rod or bar (such as concrete-reinforcing rod or bar) is cooled by convection or radiation, the law of cooling almost only depends on its diameter, which has the result that, for a bar of a specific diameter, it is necessary in order to modify its elastic limit, to use other means in order to complement the pure and simple act of cooling.

Of these means, it is particularly worth mentioning the addition of dispersoidal elements (e.g., Nb and V) which cause grain refinement and precipitation hardening of the ferrite. This is indeed efficacious but has the disadvantage that the cost increases as the 'yield point' is raised.

Thus what is desired is a process which avoids the aforesaid disadvantage without the carbon and manganese contents in the steel having to be increased in a way which is unacceptable from the point of view of weldability.

SUMMARY OF THE INVENTION

The present invention provides a rolled steel rod or bar having a surface layer composed of bainite or martensite, and a core composed of ferrite and carbides, the rod or bar having been produced in a hot rolling mill by a process comprising: superficially quenching the rod or bar at the exit of a finishing stand, to transform austenite in the surface layer of the rod or bar to bainite or martensite, with the core of the rod or bar remaining austenite; and subsequently cooling the rod or bar at such a rate that the core of austenite transforms to ferrite and carbides while the surface layer is tempered by heat transferred from the core.

From the practical point of view, the desired quenching of the bar is obtained by selecting the cooling devices and suitably adjusting the length and arrangement of these devices, for example cooling sprays.

Although, whatever conditions of quenching are applied to the rod or bar, the mechanical properties of the rod or bar are improved compared with bars which have not been subjected to this treatment, it has nevertheless been found that the improvement increases as the heat transfer coefficient of the quenching installation increases. Thus, for a treatment lasting 0.55 second, the steel may have an yield point of 45 kg/mm² when the installation has a low heat transfer coefficient, and may have an yield point of 65 kg/mm² if this coefficient is raised, if, for example, a short cooling spray is used but where very intense cooling of the rod or bar has taken place (e.g. if the water contains a mineral salt or a surface-active agent in suspension or solution).

The example just given allows the improvement in the quality of the rod or bar obtained by implementing the process of the invention to be appreciated. The rolled test-pieces examined were concrete-reinforcing bars 12 mm in diameter and of steel having the following composition:

| | | |
|---|---|---|
| carbon | : | 0.24% |
| manganese | : | 1.38% |
| silicon | : | 0.08% |
| aluminium | : | 0.002% |
| sulphur | : | 0.020% |

In the as-rolled state, the bars in question had the following properties:

| | | | | |
|---|---|---|---|---|
| Yield Point | (Re) | : | 35 ± 1 | kg/mm² |
| Tensile strength | (Rr) | : | 58 ± 2 | kg/mm² |
| Elongation | (A) | : | 33 ± 2 | % |

Treated according to the process of the invention, by passing through a water spray with a high heat transfer coefficient, the bars had the following properties:

| Time in water spray | Re kg/mm² | A % | Re/Rr |
|---|---|---|---|
| 0.45 second | 50 | 27 | 0.75 |
| 0.65 second | 75 | 19 | 0.85 |

The process according to the invention enables a rod and bar of a particular type to be obtained, namely having a bainitic or martensitic surface layer and a core composed of ferrite and carbides.

DESCRIPTION OF THE DRAWINGS

Figure 1:
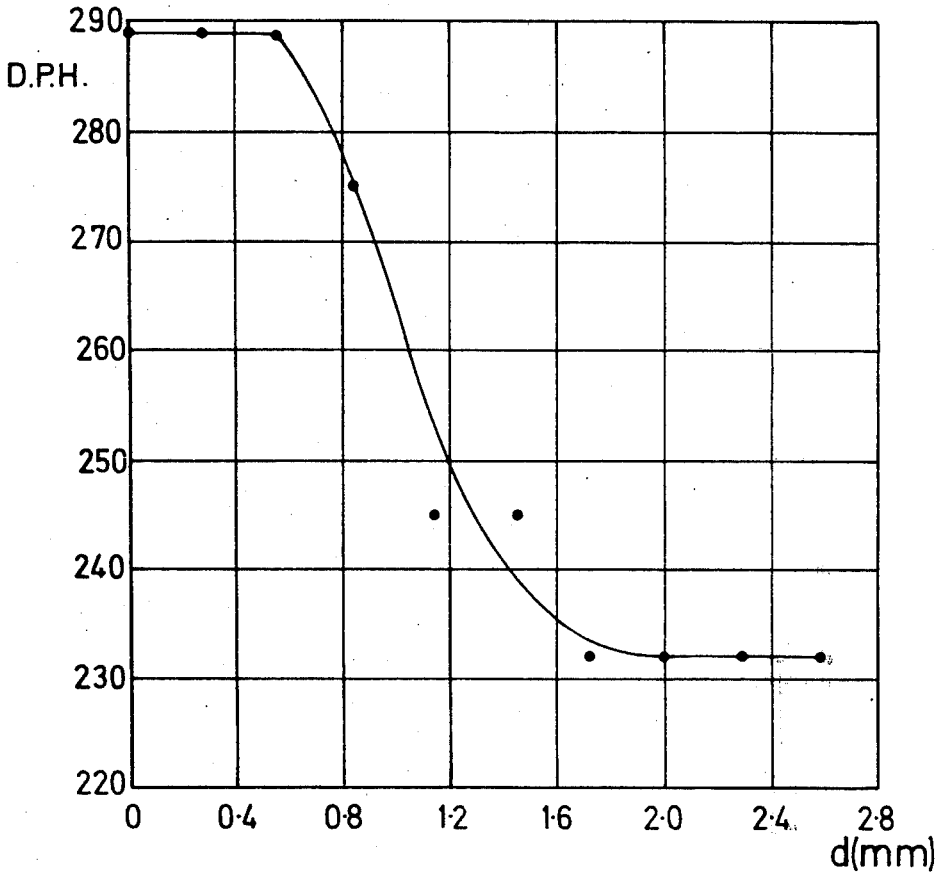
FIG. 1 is graph of hardness against depth, for a round bar.

FIG. 1 shows the variation of the hardness of the steel along a radius of a cross section of a concrete-reinforcing bar as treated according to the invention. The hardness (DPH) is shown along the ordinate while the abscissa indicates the distance (*d*) from the surface of the bar.

Figure 2A:
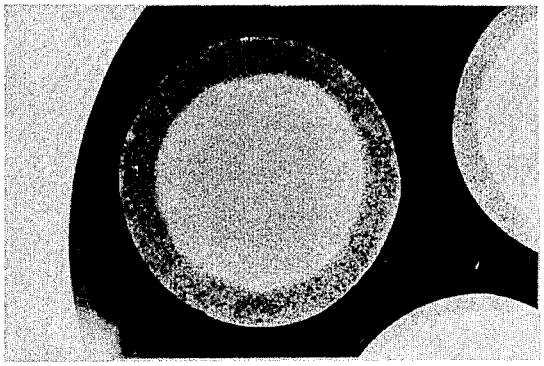
FIG. 2*a* is a photograph of the cross section of a round bar.
Figure 2B:
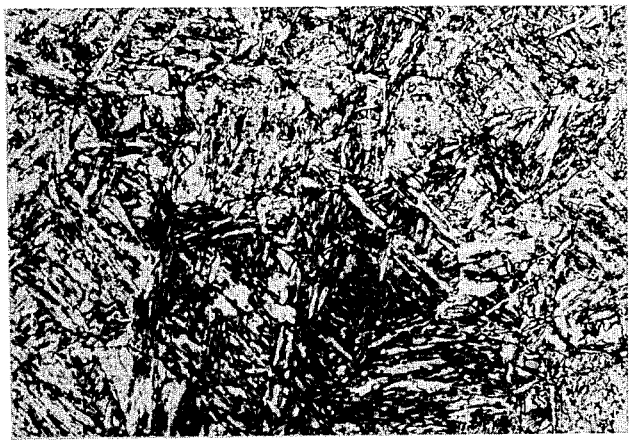
FIG. 2*b* is a photomicrogrpah of the surface layer of the bar.
Figure 2C:
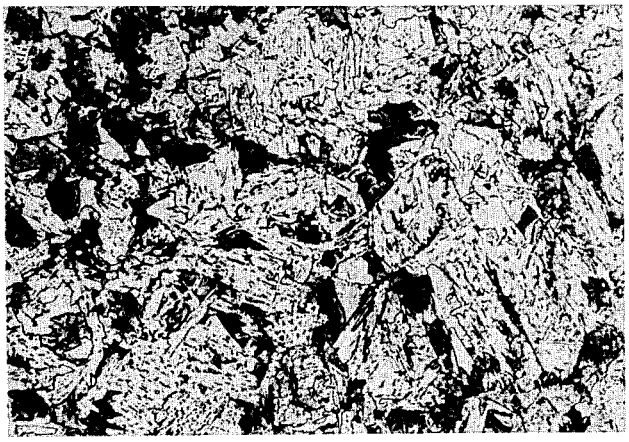
FIG. 2*c* is a photomicrograph of the core of the bar.

FIG. 2*a* illustrates a cross section of a concrete-reinforcing bar treated according to the invention in which the surface layer and core can be distinctly seen. FIG. 2*b* shows the martensitic surface layer, and FIG. 2*c* shows the ferrite and carbides which constitute the core of the bar (magnification: 500 x).

We claim:

1. Rolled steel rod or bar having a surface layer composed of bainite or martensite, and a core composed of ferrite and carbides, the rod or bar having been produced in a hot rolling mill by a process comprising: superficially quenching the rod or bar at the exit of a finishing stand, to transform austenite in the surface layer of the rod or bar to bainite or martensite, with the core of the rod or bar remaining austenite; and subsequently cooling the rod or bar at such a rate that the core of austenite transforms to ferrite and carbides while the surface layer is tempered by heat transferred from the core.

2. The rod or bar of claim 1, wherein the core has a temperature of approximately 850° C at the end of the superficial quenching step.

3. The rod or bar of claim 1, wherein the rod or bar is superficially quenched with water.

4. The rod or bar of claim 3, wherein the water contains a mineral salt or a surface-active agent, in suspension or solution.

5. The rod or bar of claim 1, wherein the rate of removal of heat from the rod or bar during superficial quenching is higher than that obtained in a water quench.

* * * * *